US010759030B2

(12) United States Patent
Pomeroy et al.

(10) Patent No.: US 10,759,030 B2
(45) Date of Patent: Sep. 1, 2020

(54) DEPTH OF DRIVE ADJUSTMENT MECHANISM FOR GAS SPRING FASTENER DRIVER

(71) Applicant: TTI (MACAO COMMERCIAL OFFSHORE) LIMITED, Macau (MO)

(72) Inventors: Edward Pomeroy, Piedmont, SC (US); Zachary Scott, Easley, SC (US); John Schnell, Anderson, SC (US); Adam Gathers, Anderson, SC (US); Essam Namouz, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 280 days.

(21) Appl. No.: 15/807,732

(22) Filed: Nov. 9, 2017

(65) Prior Publication Data

US 2018/0126531 A1 May 10, 2018

Related U.S. Application Data

(60) Provisional application No. 62/419,585, filed on Nov. 9, 2016.

(51) Int. Cl.

| | |
|---|---|
| ***B25C 1/04*** | (2006.01) |
| ***B25C 1/06*** | (2006.01) |
| ***B25C 1/00*** | (2006.01) |

(52) U.S. Cl.

CPC ..... *B25C 1/047* (2013.01); *B25C 1/008* (2013.01); *B25C 1/04* (2013.01); *B25C 1/06* (2013.01)

(58) Field of Classification Search

CPC ..... B25C 1/008; B25C 1/047; B25C 1/188
See application file for complete search history.

(56) References Cited

U.S. PATENT DOCUMENTS 4,483,473 A * 11/1984 Wagdy ..... F02P 11/04 123/46 SC
4,522,162 A * 6/1985 Nikolich ..... B25C 1/08 123/46 SC
5,263,842 A 11/1993 Fealy
5,839,638 A * 11/1998 Ronn ..... B25C 1/008 227/8

(Continued)

FOREIGN PATENT DOCUMENTS

JP 2005001065 A 1/2005

OTHER PUBLICATIONS

Australian Patent Office Examination Report for Application No. 2017258913 dated Oct. 5, 2018, 3 pages.

(Continued)

*Primary Examiner* — Thanh K Truong
*Assistant Examiner* — Daniel Jeremy Leeds
(74) *Attorney, Agent, or Firm* — Michael Best & Friedrich LLP

(57) ABSTRACT

A fastener driver includes a first nosepiece and a second nosepiece coupled to the first nosepiece with a fastener driving channel formed between the first nosepiece and the second nosepiece. A workpiece contact element is movable with respect to the first nosepiece and the second nosepiece between an extended position and a retracted position. A quick-release latch secures the first nosepiece and the second nosepiece together. The workpiece contact element is positioned between the quick-release latch and the first nosepiece.

18 Claims, 7 Drawing Sheets

(56) References Cited

U.S. PATENT DOCUMENTS

| | | | | |
|---|---|---|---|---|
| 6,012,622 | A * | 1/2000 | Weinger | B25C 1/005 227/8 |
| 6,145,724 | A * | 11/2000 | Shkolnikov | B25C 1/08 227/8 |
| 6,186,386 | B1 * | 2/2001 | Canlas | B25C 1/008 227/142 |
| 6,371,348 | B1 * | 4/2002 | Canlas | B25C 1/008 123/46 SC |
| 6,431,429 | B1 * | 8/2002 | Canlas | B25C 1/047 227/130 |
| 6,651,862 | B2 * | 11/2003 | Driscoll | B25C 1/08 227/120 |
| 6,679,414 | B2 * | 1/2004 | Rotharmel | B25C 1/184 227/119 |
| 2004/0149800 | A1 | 8/2004 | Perra et al. | |
| 2005/0218175 | A1 * | 10/2005 | Schell | B25C 1/06 227/8 |
| 2005/0218176 | A1 | 10/2005 | Schell et al. | |
| 2006/0065692 | A1 | 3/2006 | Taylor et al. | |
| 2007/0272422 | A1 | 11/2007 | Coleman | |
| 2008/0290129 | A1 * | 11/2008 | Schell | B25C 1/005 227/8 |
| 2012/0228354 | A1 * | 9/2012 | Schwartzenberger | B25C 1/188 227/109 |
| 2013/0320067 | A1 | 12/2013 | Gregory et al. | |

OTHER PUBLICATIONS

European Patent Office Search Report for Application No. 17200939.1 dated Apr. 11, 2018, 8 pages.

* cited by examiner

DEPTH OF DRIVE ADJUSTMENT MECHANISM FOR GAS SPRING FASTENER DRIVER

CROSS-REFERENCE TO RELATED APPLICATIONS

This application claims priority to U.S. Provisional Patent Application No. 62/419,585 filed on Nov. 9, 2016, the entire content of which is incorporated herein by reference.

FIELD OF THE INVENTION

The present invention relates to powered fastener drivers, and more specifically to a depth of drive adjustment mechanism for a gas spring fastener driver.

BACKGROUND OF THE INVENTION

There are various fastener drivers known in the art for driving fasteners (e.g., nails, tacks, staples, etc.) into a workpiece. These fastener drivers typically include an adjustment to adjust the depth to which a fastener is driven in to a workpiece, but often these designs are met with size and cost constraints.

SUMMARY OF THE INVENTION

The present invention provides, in one aspect, a fastener driver including a first nosepiece, a second nosepiece coupled to the first nosepiece with a fastener driving channel formed between the first nosepiece and the second nosepiece. The fastener driver also includes a workpiece contact element that is movable with respect to the first nosepiece and the second nosepiece between an extended position and a retracted position. The fastener driver also includes a quick-release latch that is operable to secure the first nosepiece and the second nosepiece together. The workpiece contact element is positioned between the quick-release latch and the first nosepiece.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
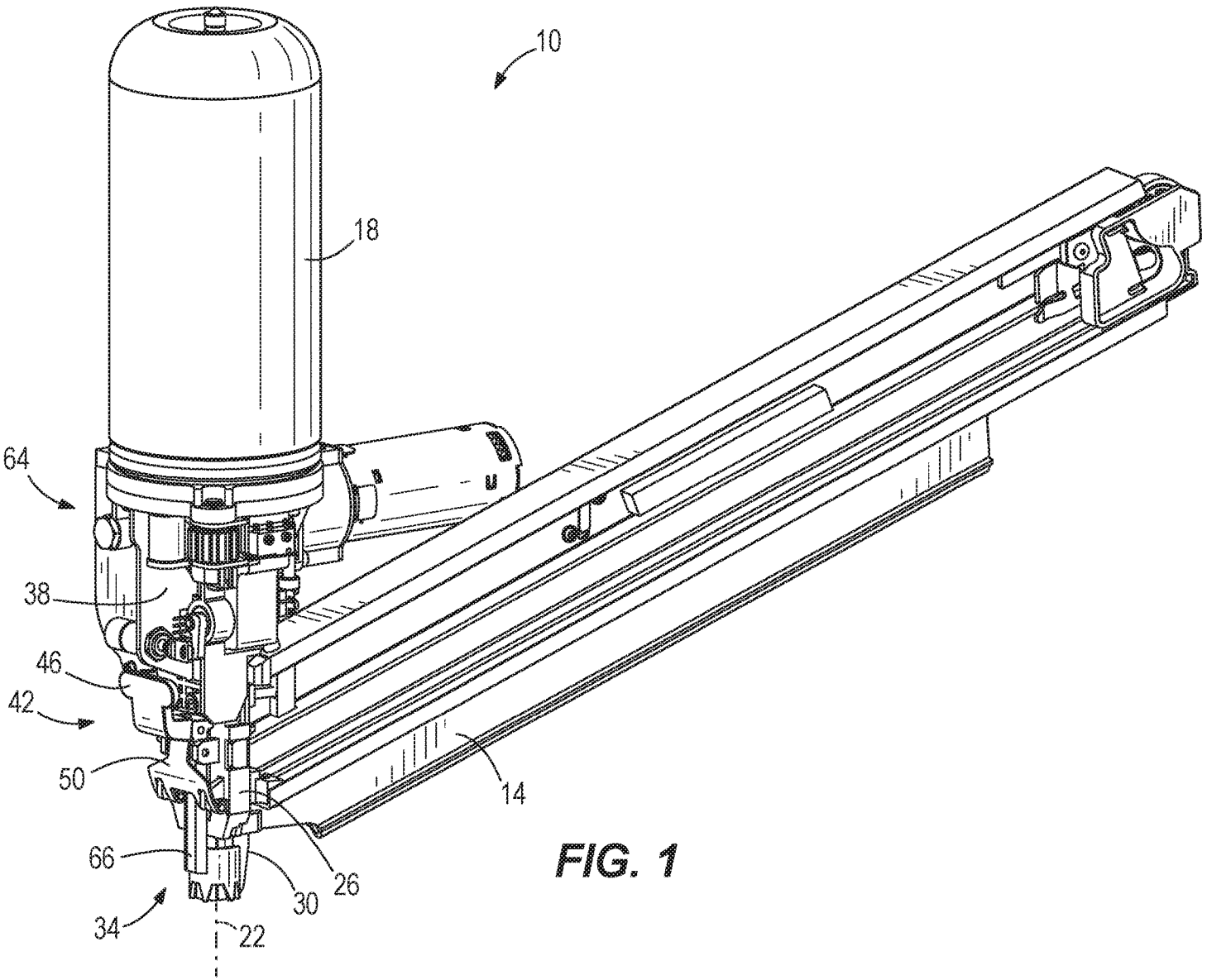
FIG. 1 is perspective view of a gas spring-powered fastener driver in accordance with an embodiment of the invention.
Figure 2A:
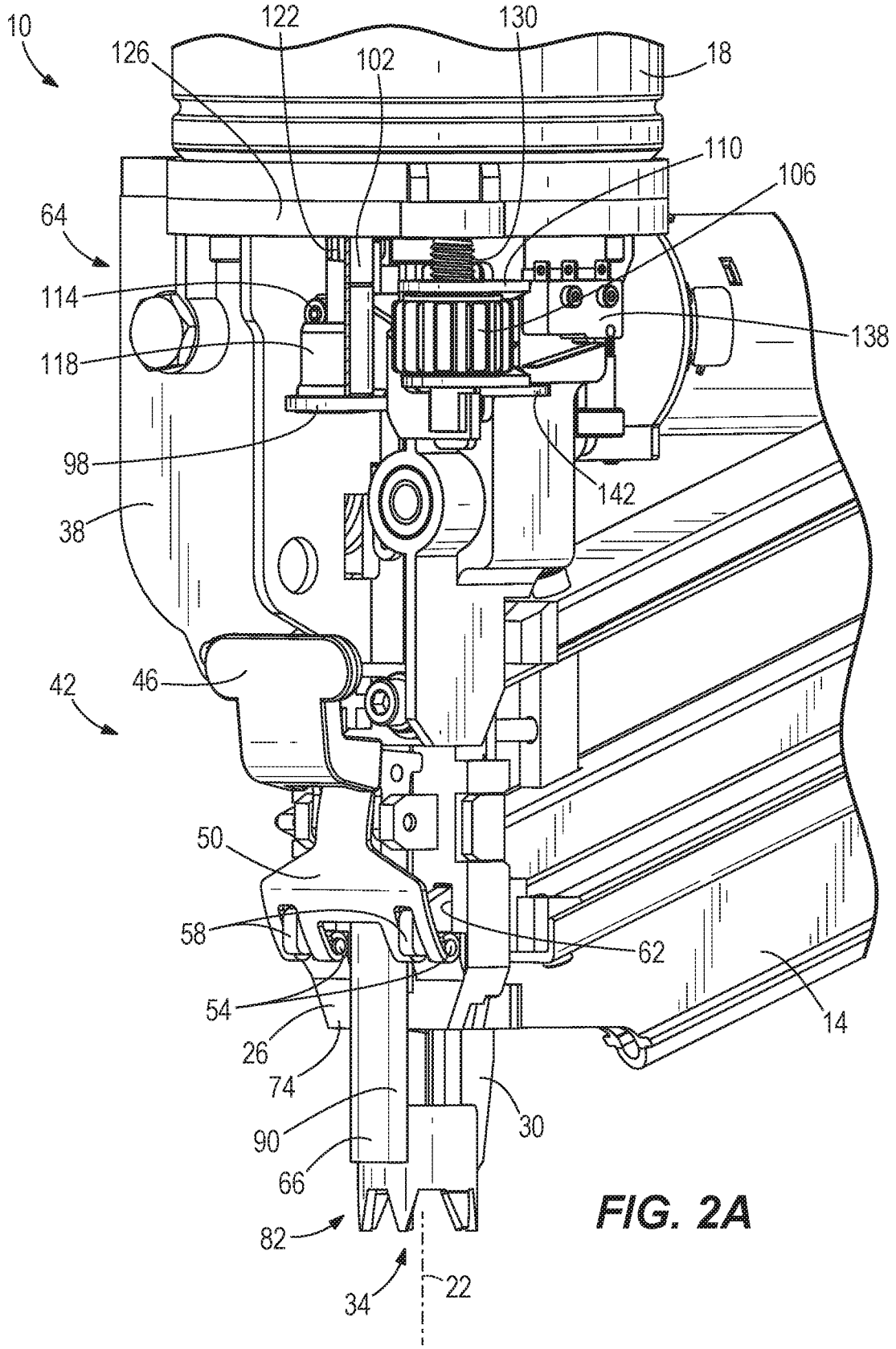
FIG. 2A is an enlarged perspective view of a depth of drive adjustment assembly including a workpiece contact element, shown in an extended position.
Figure 2B:
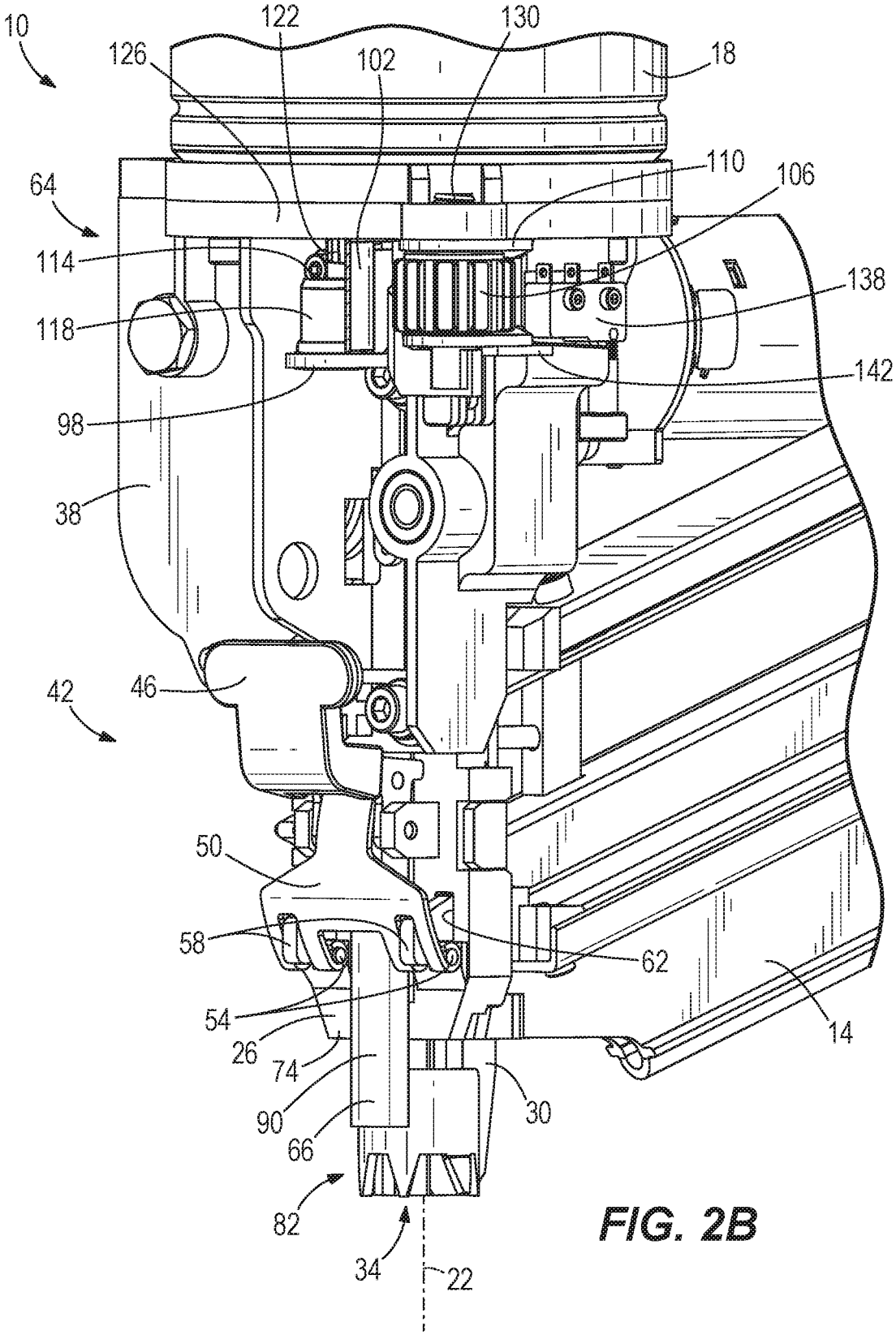
FIG. 2B is an enlarged perspective view of the depth of drive adjustment and the workpiece contact element of FIG. 2A, shown in a retracted position.
Figure 5A:
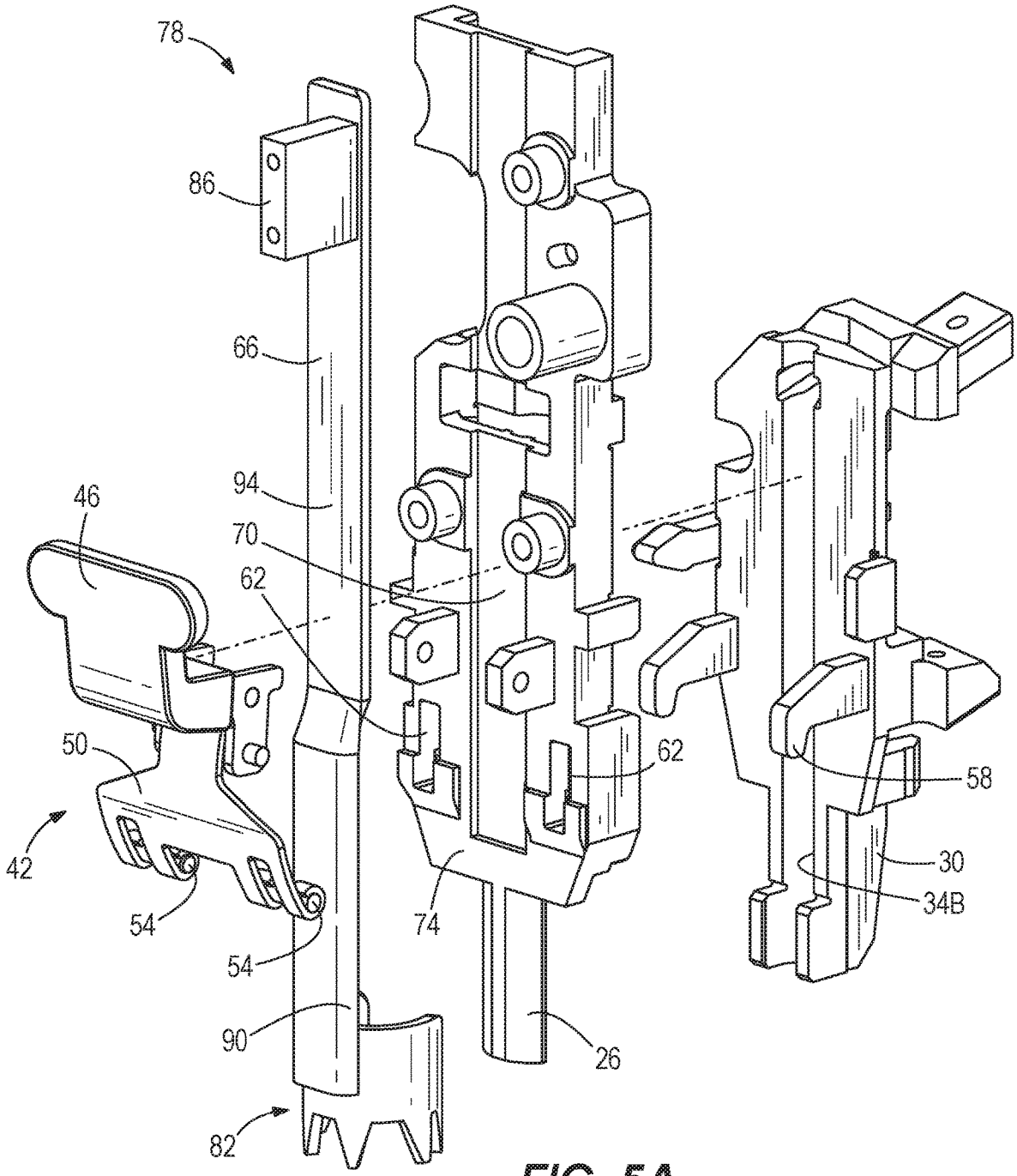
FIG. 5A is an exploded front view of a quick-release latch, the workpiece contact element, a front nosepiece, and a rear nosepiece of the gas spring-powered fastener driver of FIG. 1.
Figure 5B:
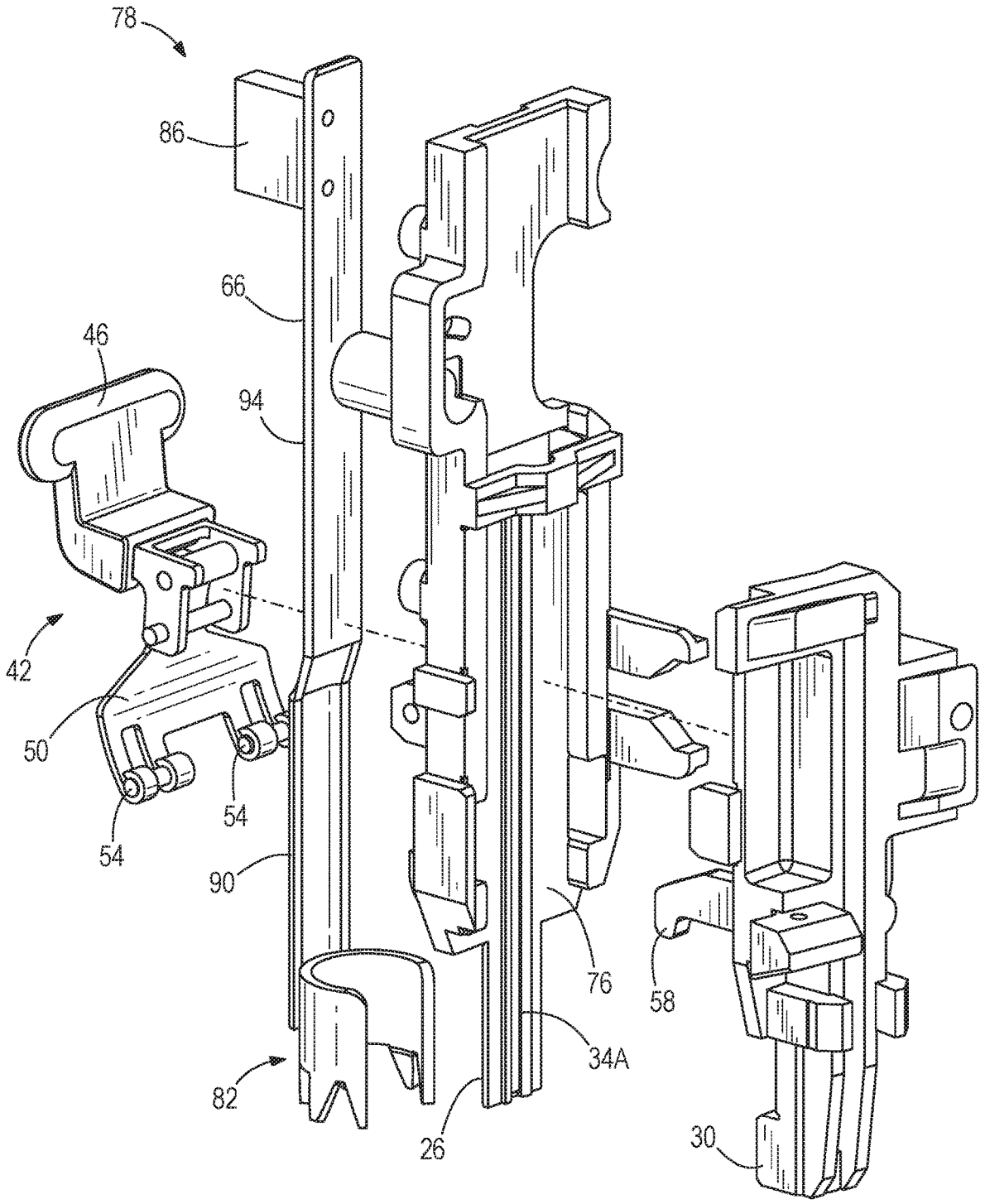
FIG. 5B is an exploded rear view of the quick-release latch, the workpiece contact element, the front nosepiece, and the rear nosepiece of FIG. 5A.

With reference to FIGS. 1-2B, a gas spring-powered fastener driver 10 is operable to drive fasteners (e.g., nails, tacks, staples, etc.) held within a magazine 14 into a workpiece. The fastener driver 10 includes a cylinder assembly 18 and a moveable piston (not shown) positioned within the cylinder assembly 18. The fastener driver 10 further includes a driver blade (not shown) that is attached to the piston and moveable therewith. The driver blade translates along a driving axis 22 to drive a fastener into the workpiece. The fastener driver 10 includes a first nosepiece 26 (i.e., a front nosepiece) and a second nosepiece 30 (i.e., a rear nosepiece). A fastener driving channel 34 is defined between the front nosepiece 26 and the rear nosepiece 30, and extends along the driving axis 22. With reference to FIGS. 5A and 5B, the fastener driving channel 34 is defined with a channel portion 34A in the front nosepiece 26 and a channel portion 34B in the rear nosepiece 30

With reference to FIGS. 2A and 2B, the front nosepiece 26 is secured to an upper housing 38 of the fastener driver 10, and a quick-release latch 42 is operable to secure the rear nosepiece 30 (and the attached magazine 14) to the front nosepiece 26. The quick-release latch 42 includes a user-actuated lever 46, a leaf spring 50 pivotably coupled to the lever 46, and spaced coaxial pins 54 on a lower end of the spring 50 that engage corresponding hooks 58 on the rear nosepiece 30. In the illustrated embodiment, the hooks 58 on the rear nosepiece 30 extend through respective apertures or windows 62 formed in the front nosepiece 26. Using the quick-release latch 42, the rear nosepiece 30 and the magazine 14 can be attached and detached from the front nosepiece 26 without the use of tools.

Figure 3:
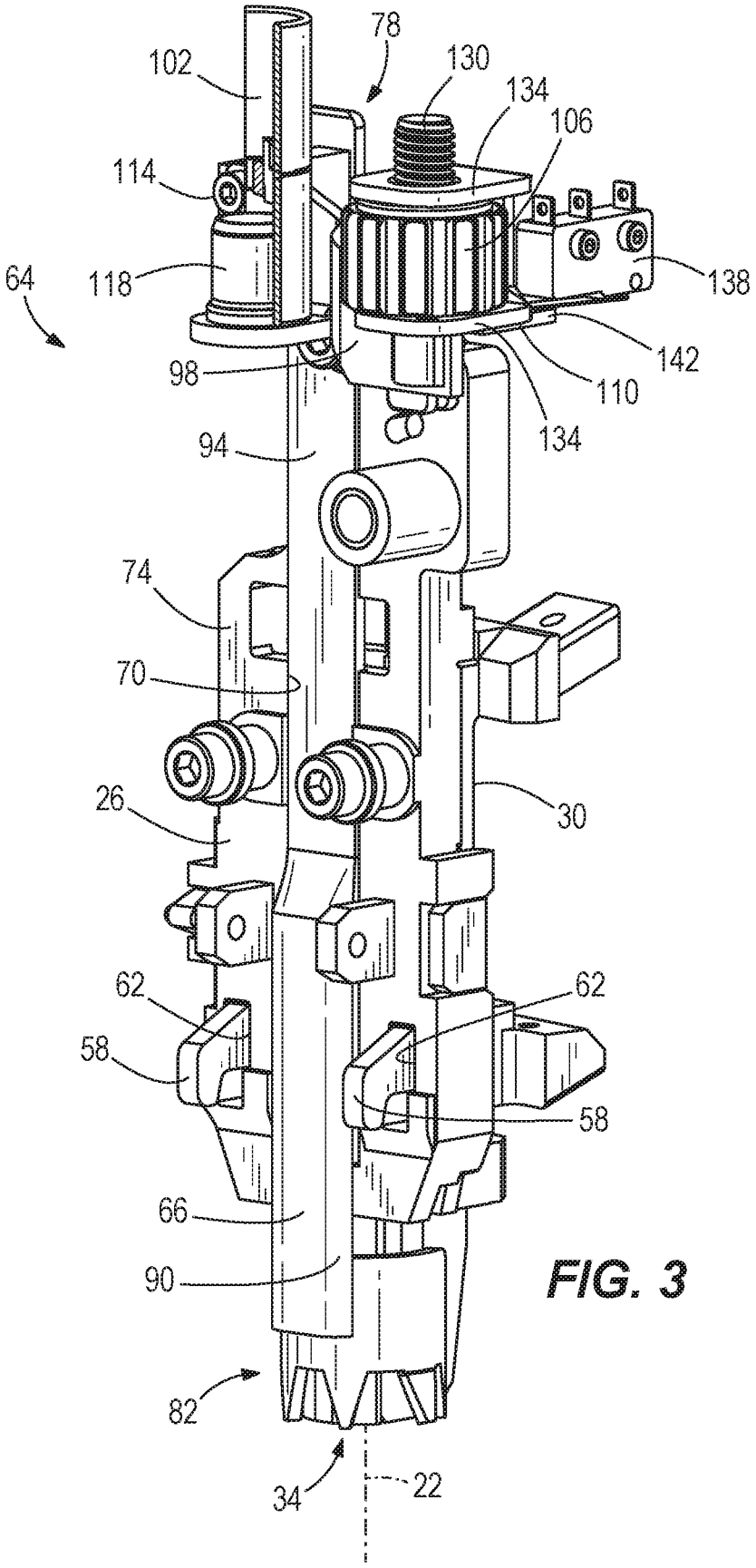
FIG. 3 is a partial perspective view similar to FIG. 2B, with portions removed for clarity.

With reference to FIGS. 2A-3, the fastener driver 10 further includes a depth of drive adjustment assembly 64 including a workpiece contact element 66. The workpiece contact element 66 is movable with respect to the front nosepiece 26 between an extended position (FIG. 2A) and a retracted position (FIG. 2B). Specifically, as explained in greater detail below, the workpiece contact element 66 moves from the extended position (FIG. 2A) to the retracted position (FIG. 2B) when the workpiece contact element 66 contacts a workpiece and a force directed toward the workpiece is applied to the fastener driver 10. The front nosepiece 26 includes a groove 70 (FIGS. 3 and 5A) that slidably receives the workpiece contact element 66. In the illustrated embodiment, the groove 70 is defined in a front surface 74 of the front nosepiece 26. In other words, the groove 70 is formed on the front surface 74, which is opposite the fastener driving channel 34. More specifically, the groove 70 is formed in the front surface 74 of the front nosepiece 26, which is opposite the channel portion 34A formed on a rear surface 76 (FIG. 5B) of the front nosepiece 26.

In the illustrated embodiment, the workpiece contact element 66 is positioned between the quick-release latch 42 and the front nosepiece 26. In other words, the workpiece contact element 66 is positioned in front of the front nosepiece 26. And, the workpiece contact element 66 extends in the direction of the driving axis 22, or generally parallel with the driving axis 22, which is also parallel with the groove 70. This positioning of the workpiece contact element 66 ensures a clear line of sight to the workpiece, which might otherwise be obstructed if the workpiece contact element 66 extended along the side of either of the nosepieces 26 and 30. As such, no portion of the workpiece contact element 66 extends along the side of either of the nosepieces 26, 30, therefore offering a compact design that does not block an operator's view of the workpiece or a view of the location on the workpiece where the fastener will be driven.

Figure 4:
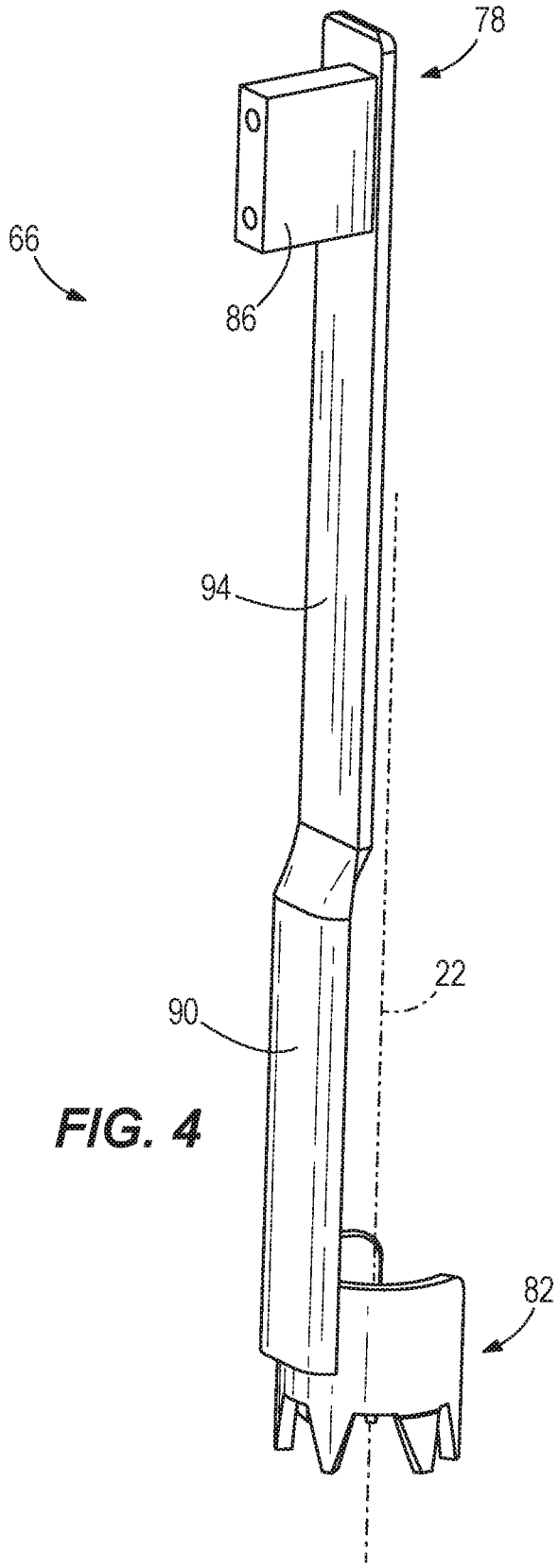
FIG. 4 is a perspective view of the workpiece contact element of FIG. 2A.

With reference to FIG. 4, the workpiece contact element 66 is linear. In particular, the workpiece contact element 66 includes an upper end 78 positioned directly above a lower end 82 when viewed from the front of the workpiece contact element 66. The workpiece contact element 66 includes a mounting block 86 to secure the workpiece contact element 66 to the remaining portions of the depth of drive adjustment assembly 64. In the illustrated embodiment, a rounded portion 90 of the workpiece contact element 66 transitions to a planar portion 94 that is slidably received with the groove 70 on the front nosepiece 26.

With reference to FIG. 3, the depth of drive adjustment assembly 64 also includes a first bracket 98, a spring 102, an adjustment knob 106, and a second bracket 110. The upper end 78 of the workpiece contact element 66 is secured to the first bracket 98 by fasteners 114. The first bracket 98 includes a seat 118 upon which to support the spring 102. The spring 102 is also supported on a seat 122 (FIGS. 2A and 2B) formed on a mounting flange 126 of the upper housing 38. As such, the spring 102 biases the first bracket 98 and the workpiece contact element 66 away from the mounting flange 126, towards the extended position. A screw portion 130 is formed as part of the first bracket 98 and is received within a threaded bore of the adjustment knob 106. The second bracket 110 supports the adjustment knob 106 between two flanges 134. The second bracket 110 and the adjustment knob 106 translate with the first bracket 98 and workpiece contact element 66 between the extended position (FIG. 2A) and the retracted position (FIG. 2B).

The depth of drive adjustment assembly 64 adjusts the depth to which a fastener is driven into the workpiece. In particular, the depth of drive adjustment assembly 64 adjusts the effective length of the combination of the workpiece contact element 66 and the first bracket 98, and changes the distance between the nosepieces 26, 30 and the workpiece when the workpiece contact element 66 is in the retracted position (coinciding with initiation of a fastener driving operation). In other words, the depth of drive adjustment assembly 64 adjusts how far the workpiece contact element 66 extends past the nosepieces 26, 30 when a fastener is driven into a workpiece. As such, when the workpiece contact element 66 is in the retracted position, the position of the workpiece contact element 66 with respect to the front nosepiece 26 is adjustable to adjust the depth to which a fastener is driven.

With continued reference to FIGS. 2A-3, the fastener driver 10 further includes a switch 138 (e.g., a microswitch) operable to detect when the workpiece contact element 66 is positioned against a workpiece. In other words, the switch 138 determines when the workpiece contact element 66 is in the retracted position (FIG. 2B). Upon reaching the retracted position (FIG. 2B), a finger 142 on the second bracket 110 engages an actuation arm of the switch 138, thereby closing the switch 138 (if the switch 138 is normally open) to allow activation of the fastener driver 10. Activation of the fastener driver 10 is prevented when the workpiece contact element 66 is in the extended position (FIG. 2A).

Various features of the invention are set forth in the following claims.

What is claimed is:

1. A fastener driver comprising:

a first nosepiece;

a second nosepiece coupled to the first nosepiece with a fastener driving channel formed between the first nosepiece and the second nosepiece;

a workpiece contact element movable with respect to the first nosepiece and the second nosepiece between an extended position and a retracted position; and a quick-release latch that is operable to secure the first nosepiece and the second nosepiece together, wherein the workpiece contact element is positioned between the quick-release latch and the first nosepiece, wherein the first nosepiece includes a groove in which the workpiece contact element is received, and wherein the groove is formed on a surface of the first nosepiece that is opposite the fastener driving channel.

2. The fastener driver of claim 1, wherein the workpiece contact element includes a planar portion slidably received in the groove.

3. The fastener driver of claim 2, wherein the second nosepiece includes two hooks, respectively, positioned on opposite sides of the groove, and wherein the quick-release latch is engaged with the hooks to secure the first nosepiece and the second nosepiece together.

4. The fastener driver of claim 3, wherein the first nosepiece defines respective apertures through which the hooks extend.

5. The fastener driver of claim 4, wherein the quick-release latch includes a lever and a spring pivotably coupled to the lever, wherein the lever is pivotably coupled to the first nosepiece.

6. The fastener driver of claim 5, wherein the quick-release latch further includes spaced pins positioned on a lower end of the spring and engageable with the hooks, respectively, for securing the first nosepiece and the second nosepiece together.

7. The fastener driver of claim 5, further comprising a magazine attached to the second nosepiece.

8. The fastener driver of claim 1, wherein the groove is located in the middle of the first nosepiece between opposite lateral sides of the first nosepiece.

9. The fastener driver of claim 1, wherein the fastener driving channel defines a driving axis and the workpiece contact element extends in the direction of the driving axis.

10. The fastener driver of claim 9, wherein the groove is parallel with the driving axis.

11. The fastener driver of claim 1, wherein the position of the workpiece contact element with respect to the first nosepiece, when the workpiece contact element is in the retracted position, is adjustable to adjust the depth to which a fastener is driven.

12. The fastener driver of claim 1, further comprising a spring biasing the workpiece contact element towards the extended position.

13. The fastener driver of claim 12, further comprising a bracket to which the workpiece contact element is coupled for movement therewith, wherein the bracket includes a seat upon which one end of the spring is supported.

14. The fastener driver of claim 13, further comprising an adjustment knob threaded to a screw portion of the bracket, wherein the bracket and the adjustment knob translate with the workpiece contact element between the extended position and the retracted position.

15. The fastener driver of claim 14, wherein rotation of the adjustment knob relative to the screw portion of the bracket adjusts an effective length of the combined workpiece contact element and the bracket.

16. The fastener driver of claim 15, wherein the bracket is a first bracket, and wherein the fastener driver further comprises a second bracket having opposed flanges between which the adjustment knob is captured.

17. The fastener driver of claim 16, wherein the screw portion of the first bracket protrudes through the flanges.

18. The fastener driver of claim 16, wherein the second bracket includes a finger extending from one of the flanges, and wherein the fastener driver further comprises a switch actuated by the finger when the workpiece contact element is in the retracted position.

* * * * *